US007623011B2

(12) United States Patent
Rowe et al.

(10) Patent No.: US 7,623,011 B2
(45) Date of Patent: Nov. 24, 2009

(54) DEVICE FOR REMOTELY OPERATING A CIRCUIT BREAKER APPARATUS AND ASSOCIATED ASSEMBLY AND METHOD

(75) Inventors: Ronald Lee Rowe, Clemmons, NC (US); John Larkin Nelson, Lewisville, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 412 days.

(21) Appl. No.: 11/249,049

(22) Filed: Oct. 12, 2005

(65) Prior Publication Data

US 2007/0080143 A1 Apr. 12, 2007

(51) Int. Cl.
*H01H 75/00* (2006.01)
*H01H 3/00* (2006.01)

(52) U.S. Cl. ..... 335/6; 335/68; 335/172; 335/174; 335/175; 200/330; 200/331

(58) Field of Classification Search ..... 335/6, 335/14, 68, 71, 172–176; 200/329–341
See application file for complete search history.

(56) References Cited

U.S. PATENT DOCUMENTS 3,893,050 A * 7/1975 Salvati et al. ..... 335/1
4,990,873 A * 2/1991 Grunert et al. ..... 335/68
5,062,022 A 10/1991 Beard et al.
5,200,585 A 4/1993 Davies et al.
5,224,590 A 7/1993 Milianowicz et al.
5,477,016 A * 12/1995 Baginski et al. ..... 200/43.11
5,757,260 A 5/1998 Smith et al.
5,821,876 A * 10/1998 Farrington et al. ..... 340/3.2
5,838,219 A * 11/1998 Du et al. ..... 335/14
5,841,616 A * 11/1998 Crosier ..... 361/102
5,857,563 A * 1/1999 Helmer et al. ..... 200/332.1
6,034,581 A * 3/2000 DiMarco et al. ..... 335/16
6,130,392 A * 10/2000 Blessitt et al. ..... 200/400
6,204,741 B1 * 3/2001 Becker et al. ..... 335/68
6,288,348 B1 * 9/2001 Eberts et al. ..... 200/33 R
6,295,190 B1 * 9/2001 Rinaldi et al. ..... 361/115
6,411,486 B1 6/2002 Doneghue
6,472,877 B1 10/2002 Sands
6,577,963 B1 * 6/2003 Cordray et al. ..... 702/65
6,714,107 B2 * 3/2004 Mody et al. ..... 335/6
6,734,768 B2 * 5/2004 Kim ..... 335/6
6,787,937 B2 * 9/2004 Mody et al. ..... 307/115
6,861,931 B1 * 3/2005 Corliss et al. ..... 335/14
6,963,042 B1 * 11/2005 Kouris ..... 200/400
7,280,013 B2 * 10/2007 Lewis ..... 335/6

* cited by examiner

*Primary Examiner*—Ramon M Barrera
(74) *Attorney, Agent, or Firm*—Alston & Bird LLP

(57) ABSTRACT

A device for remotely operating a circuit breaker apparatus is provided. Such a circuit breaker apparatus includes a trip device and a reset device that are externally accessible with respect to an enclosure enclosing the circuit breaker apparatus. The device comprises at least one actuator capable of being operably engaged with the circuit breaker apparatus, externally to the enclosure, and in physical engagement with at least one of the trip and reset devices. A remotely disposed controller device is in communication with the at least one actuator and is capable of selectively actuating the at least one actuator, from a remote location with respect to the circuit breaker apparatus, so as to at least one of actuate the trip device to trip the circuit breaker apparatus and actuate the reset device to reset the circuit breaker apparatus. An associated assembly and method are also provided.

18 Claims, 4 Drawing Sheets

DEVICE FOR REMOTELY OPERATING A CIRCUIT BREAKER APPARATUS AND ASSOCIATED ASSEMBLY AND METHOD

BACKGROUND OF THE INVENTION

1. Field of the Invention

The present invention relates to a draw out type circuit breaker apparatus and, more particularly, to a device and associated assembly and method for remotely tripping and resetting a metal-enclosed draw out type circuit breaker apparatus.

2. Description of Related Art

Some types and configurations of circuit breaker apparatuses may implement a trip (open) actuator and/or a reset (close) actuator, both of which may be accessible by an operator of such a circuit breaker apparatus. For example, a metal-enclosed draw out type circuit breaker apparatus may incorporate open and close push-button type operating actuators disposed on or about a surface of the enclosure. The open and close operating actuators can be used for manually operating the circuit breaker apparatus so as to disrupt (open) an electrical circuit or complete (close) that circuit. Such a manual operation is often accomplished by the operator physically engaging and operating the appropriate operating actuator from immediately adjacent to the circuit breaker apparatus. However, particularly in instances where the circuit breaker apparatus handles a large electrical load, the operator may be faced with many hazards, such as shock, electrocution, sparks, explosions, or other high voltage hazards as will be appreciated by one skilled in the art. Accordingly, it may be advantageous for the operator to be able to operate the circuit breaker apparatus from a safe distance away from that apparatus. Previous attempts at such remote usage have involved, for example, developing electrical circuitry for integrally interfacing remote operational capabilities with the internal components of the circuit breaker apparatus, such circuitry often being disposed within any enclosure for the circuit breaker apparatus and inaccessible to the operator. Accordingly, should such integral remote operation circuitry or components require service, the operator is still faced with the aforementioned hazards in accessing the components disposed within the enclosure.

Thus, there exists a need for a device capable of allowing an operator to remotely operate an enclosed circuit breaker apparatus, wherein the remote operational device should be accessible externally with respect to the enclosure for the circuit breaker apparatus. Such a device should also minimize or eliminate the aforementioned hazards to the operator when operating such a circuit breaker apparatus.

BRIEF SUMMARY OF THE INVENTION

The above and other needs are met by the present invention which, in one aspect, provides a device adapted for remote operation of a circuit breaker apparatus, wherein the circuit breaker apparatus includes a trip device and a reset device operably engaged therewith, and externally accessible with respect to an enclosure enclosing the circuit breaker apparatus. Such a device comprises at least one actuator capable of being operably engaged with the circuit breaker apparatus, externally to the enclosure. The at least one actuator is also configured to be capable of physically engaging at least one of the trip device and the reset device. A controller device is in communication with the at least one actuator and is capable of being remotely disposed with respect thereto. The controller device is also capable of selectively actuating the at least one actuator, from a remote location with respect to the circuit breaker apparatus, so as to at least one of actuate the trip device to trip the circuit breaker apparatus and actuate the reset device to reset the circuit breaker apparatus.

Another aspect of the present invention comprises a circuit breaker assembly, which includes a circuit breaker apparatus having a trip device and a reset device operably engaged therewith, and configured to be externally accessible with respect to an enclosure enclosing the circuit breaker apparatus. A device configured to provide remote operation of the circuit breaker apparatus is operably engaged therewith, and includes at least one actuator capable of being operably engaged with the circuit breaker apparatus, externally to the enclosure, so as to be capable of physically engaging at least one of the trip device and the reset device. A controller device is in communication with the at least one actuator and is capable of being remotely disposed with respect thereto. The controller device is also capable of selectively actuating the at least one actuator from a remote location with respect to the circuit breaker apparatus so as to at least one of actuate the trip device to trip the circuit breaker apparatus and actuate the reset device to reset the circuit breaker apparatus.

Yet another aspect of the invention comprises a method of remotely operating a circuit breaker apparatus. First, at least one actuator is operably engaged with the circuit breaker apparatus, externally to an enclosure enclosing the circuit breaker apparatus, such that the at least one actuator is capable of physically engaging at least one of a trip device and a reset device operably engaged with the circuit breaker apparatus and externally accessible with respect to the enclosure. The at least one actuator is then controlled with a controller device, remotely disposed with respect thereto and in communication therewith, by selectively actuating the at least one actuator via the remotely disposed controller so as to at least one of actuate the trip device to trip the circuit breaker apparatus and actuate the reset device to reset the circuit breaker apparatus.

Thus, aspects of the present invention provide a device capable of allowing an operator to remotely operate an enclosed circuit breaker apparatus, wherein the remote operational device is accessible externally with respect to the enclosure for the circuit breaker apparatus. Aspects of the present invention also provide a device that minimizes or eliminates hazards to the operator, such as shock, electrocution, sparks, explosions, or other high voltage hazards as will be appreciated by one skilled in the art, when operating such a circuit breaker apparatus. Accordingly, aspects of the present invention provide significant advantages as further detailed herein.

BRIEF DESCRIPTION OF THE SEVERAL VIEWS OF THE DRAWINGS

Figure 1:
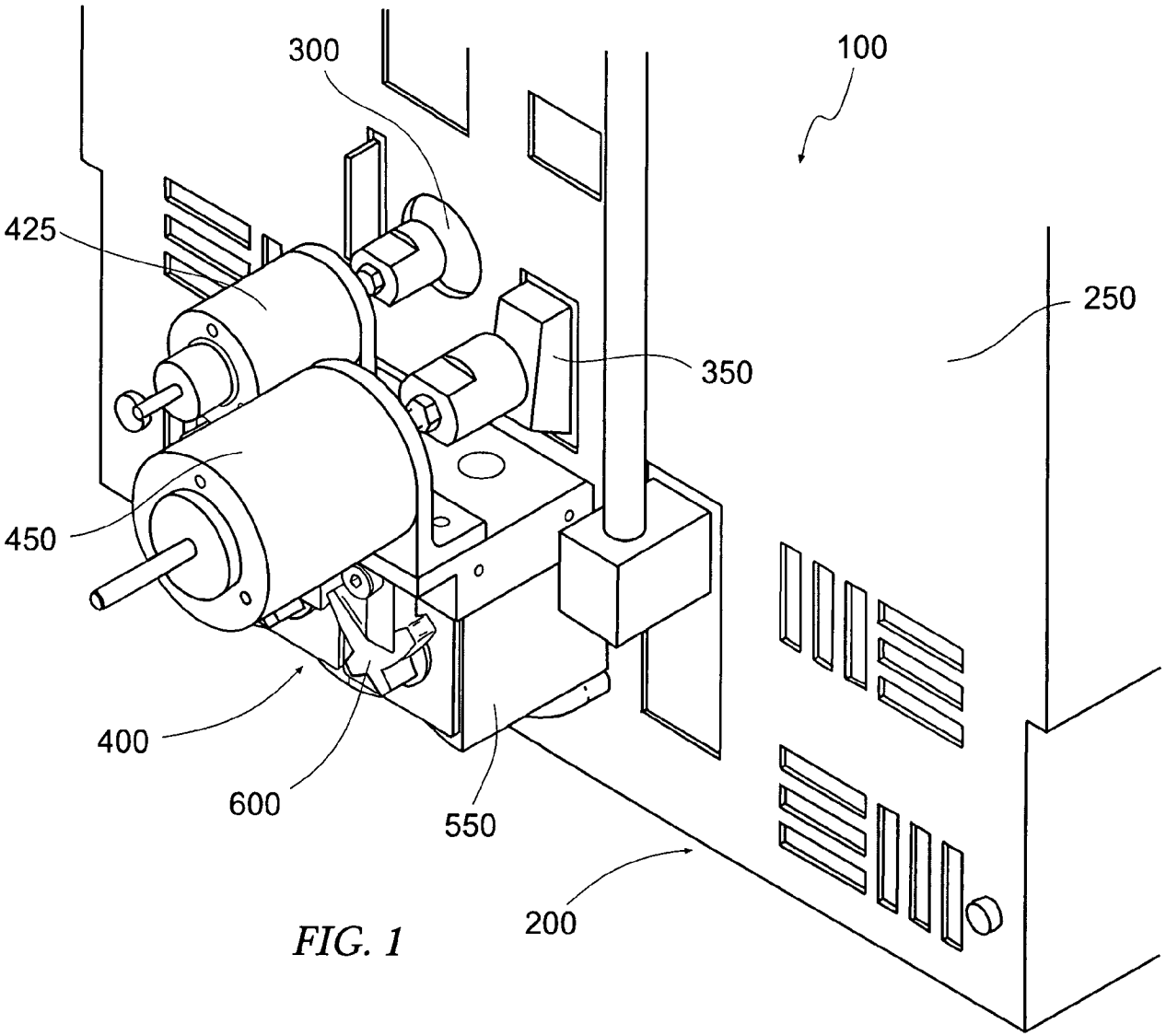
Figure 2:
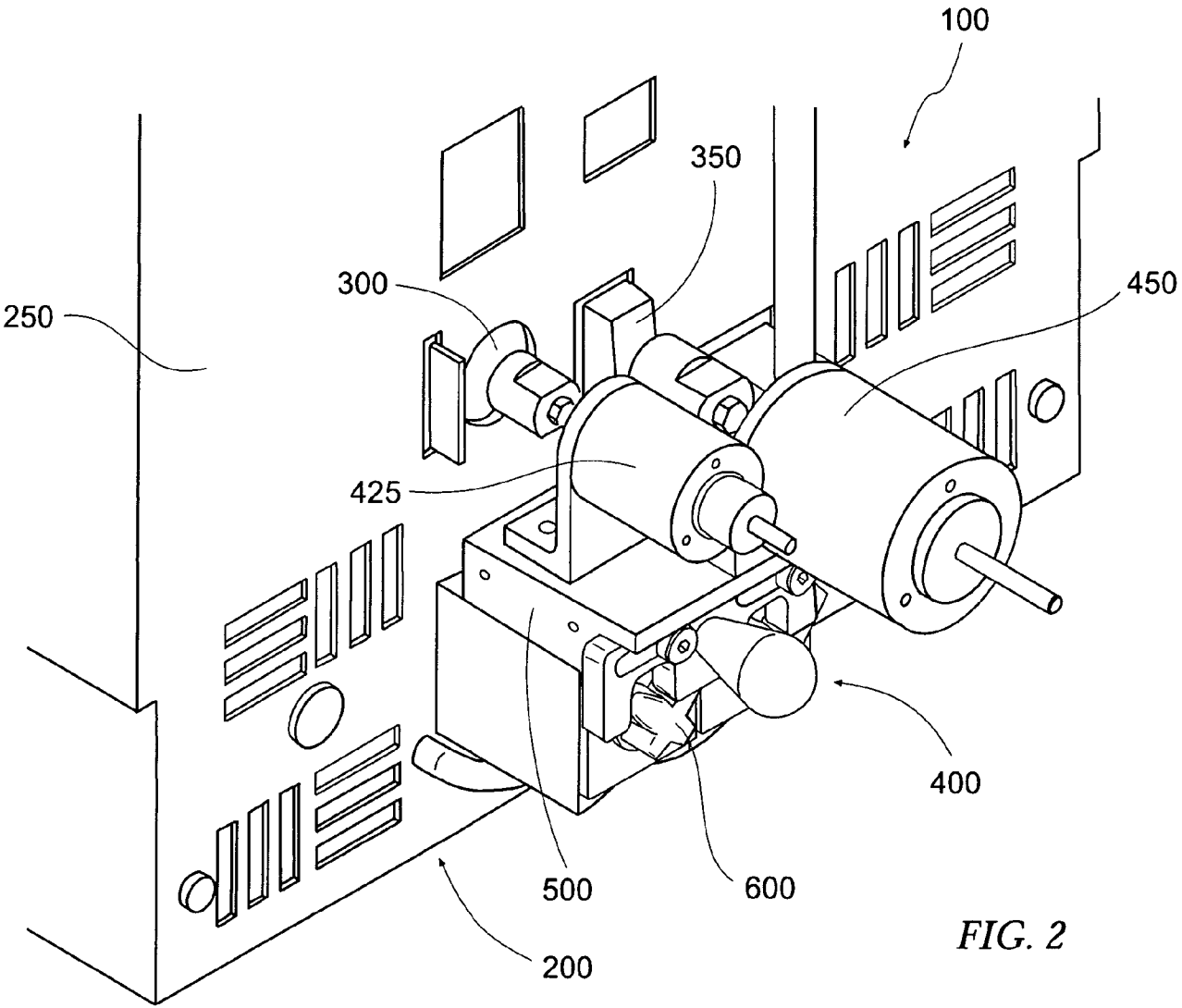
Figure 3A:
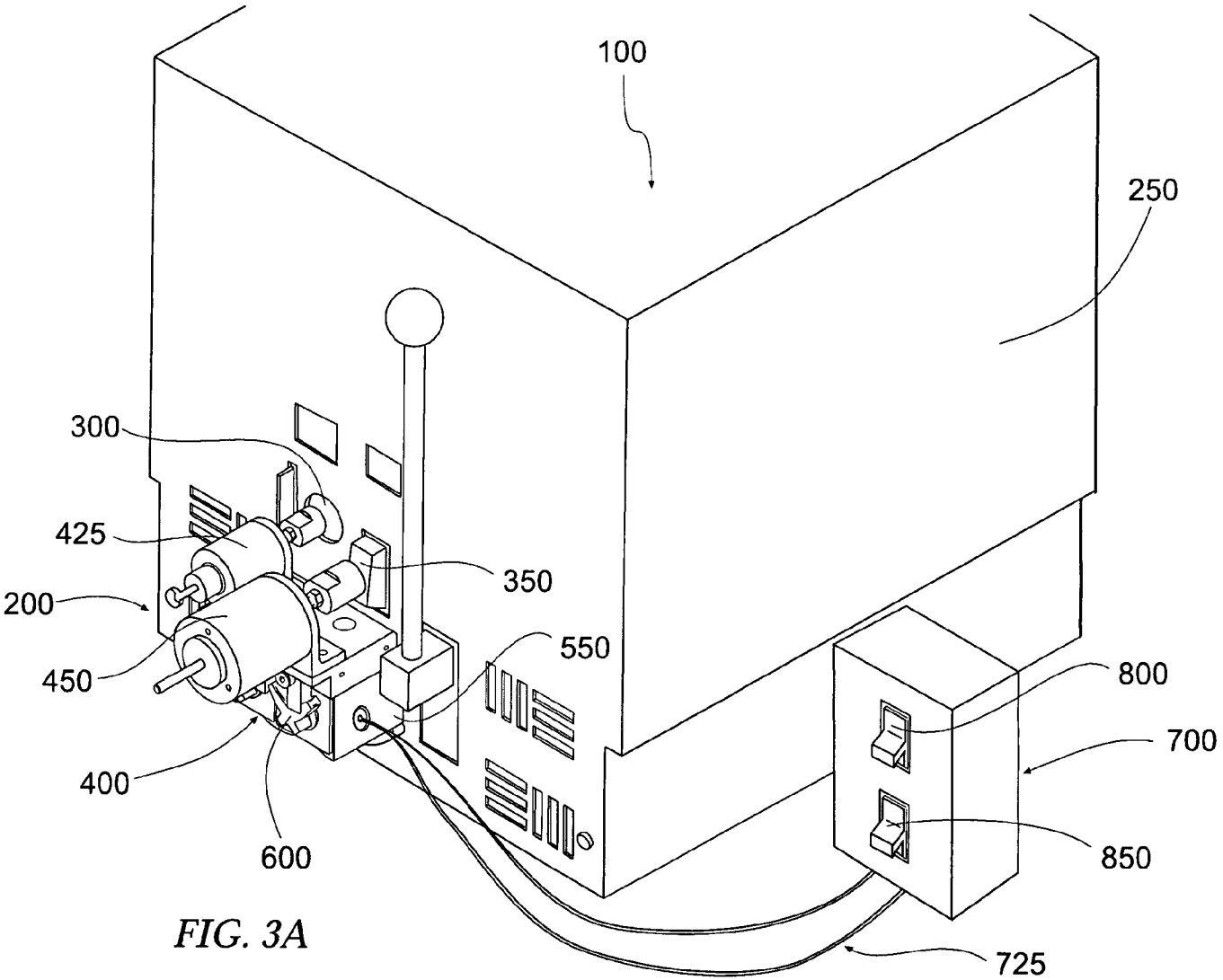
Figure 3B:
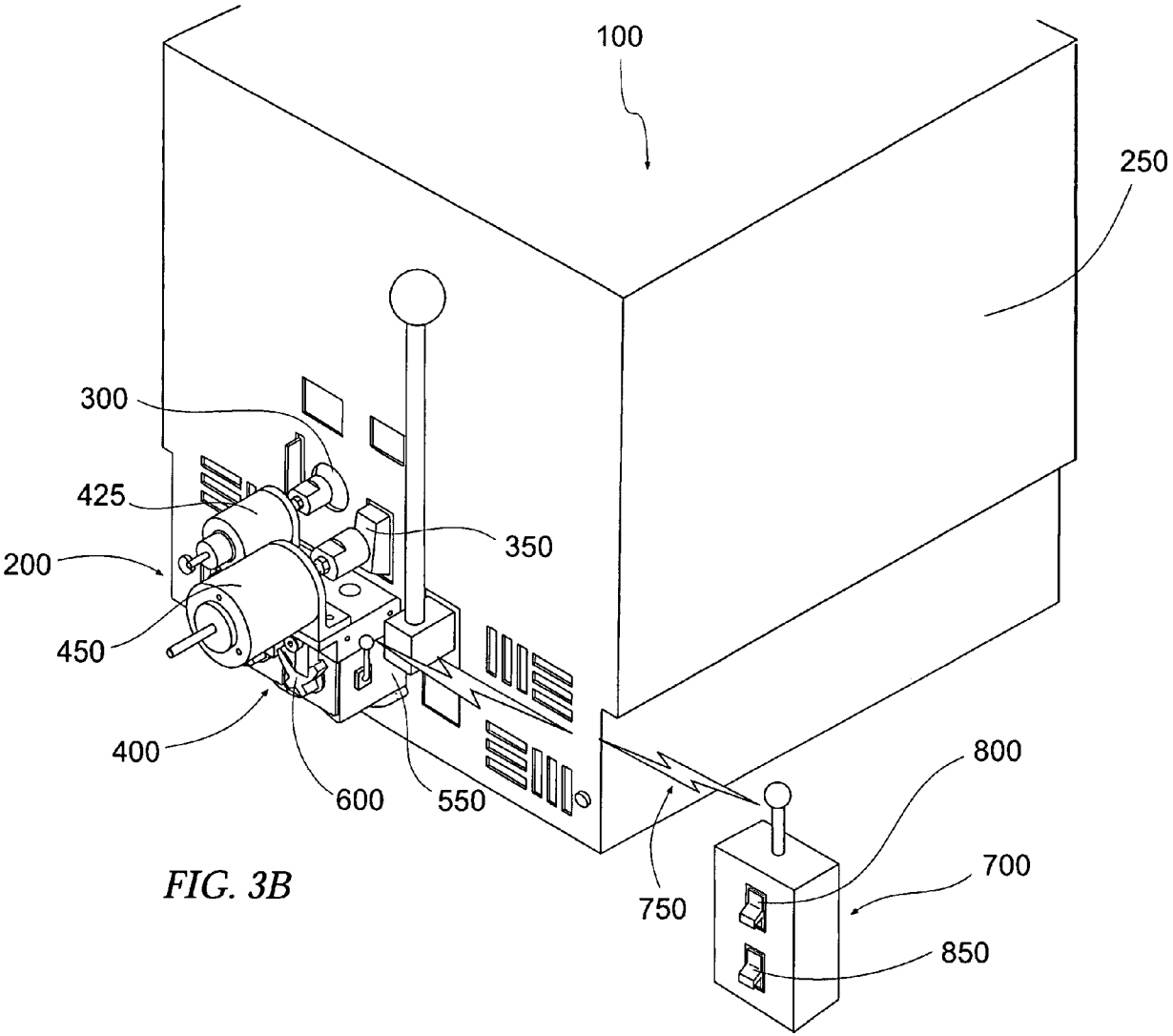

Having thus described the invention in general terms, reference will now be made to the accompanying drawings, which are not necessarily drawn to scale, and wherein:

FIGS. 1-2 are perspective views of a device for remotely operating a circuit breaker apparatus, the device being operably engaged with a circuit breaker device, according to one aspect of the present invention; and FIGS. 3A and 3B are schematics of alternate aspects of a device for remotely operating a circuit breaker apparatus in accordance with the present invention illustrating a wired control configuration and a wireless control configuration.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1, 2, 3A, and 3B illustrate various aspects of a device for remotely operating a circuit breaker apparatus according to one embodiment of the present invention, such a device being generally indicated by the numeral 100, with a representative circuit breaker apparatus being indicated by the numeral 200. The circuit breaker apparatus 200, as will be appreciated by one skilled in the art, is generally included as a portion of an electrical circuit (not shown), and configured to facilitate (close) or disrupt (open) electricity transmission to or through the electrical circuit. In some instances, the circuit breaker apparatus 200 may be enclosed, or substantially enclosed, by an enclosure 250 configured to protect the internal circuitry of the circuit breaker apparatus 200 and/or to prevent or reduce the risk of electrical shock to an operator or other personnel in the vicinity thereof. Such an enclosed circuit breaker apparatus 200 may comprise, for example, a draw out type circuit breaker, though the present invention may be applicable to many other types of enclosed circuit breakers.

A draw out type circuit breaker apparatus 200 may, in some instances, incorporate open (reset) 300 and close (trip) 350 circuit breaker operating devices disposed on or about a surface of the enclosure 250, where such circuit breaker operating devices 300, 350 may be of, for example, a push-button type. Typically, such an enclosed circuit breaker apparatus 200 is configured to be manually operated by an operator, via the circuit breaker operating devices 300, 350, and the enclosure 250 is included with the circuit breaker apparatus 200 to prevent or reduce the risk of electrical shock to the operator from incidental contact with the internal electricity-carrying components thereof. However, the operator manually operating the circuit breaker apparatus 200, from immediately adjacent thereto, may still be faced with hazards such as sparks, electrical shocks, or explosions.

In light of the risks faced by the operator, embodiments of the present invention include a device for remotely operating such a circuit breaker apparatus 200, the device being indicated by the numeral 400. Such a device 400 is configured to be operably engaged with the circuit breaker apparatus 200 so as to be capable of physically engaging and operating the open and close circuit breaker operating devices 300, 350 via respective actuators 425, 450. Such actuators 425, 450 may comprise, for example, electrically-operated solenoids configured to be capable of exerting an outwardly-directed physical force sufficient to operate the respective circuit breaker operating devices 300, 350. One skilled in the art will appreciate, however, that many other types of actuators 425, 450 may be implemented, such as hydraulic actuators or devices, and/or pneumatic actuators or devices. In some instance, for example, an appropriate mechanical linkage may be operated by a single actuator (configuration not shown) such that the selectively-actuated single actuator can be directed to operate either of the open and close circuit breaker operating devices 300, 350.

In order to position the actuators 425, 450 to operate the corresponding circuit breaker operating devices 300, 350, each actuator 425, 450 may be operably engaged with a respective fastening device 500, 550 capable of fastening the actuators 425, 450 to the circuit breaker apparatus 200. For example, in instances where the enclosure 250 is comprised of a metallic material, the fastening device(s) 500, 550 may comprise actuatable magnetic type fastening devices, as will be appreciated by one skilled in the art. In one embodiment, the magnetic type fastening device 500, 550 may be, for instance, an electromagnet that is actuated by the application of electricity thereto, the magnetic field created thereby causing the fastening device 500, 550 to be magnetically attracted to the metallic enclosure 250 so as to be secured thereto as long as the electricity is applied to the electromagnet. For this purpose, a switch device 600 may be provide in operable engagement with either or both of the fastening devices 500, 550 for providing actuation and deactuation capabilities therefor. One skilled in the art will also appreciate, however, that the fastening device(s) 500, 550 may be provided in any form or manner suitable for securing the respective actuator 425, 450 to the enclosure 250 or otherwise to the circuit breaker apparatus 200, such that the actuators 425, 450 are capable of operating the circuit breaker operating devices 300, 350. In one embodiment, as shown, the actuators 425, 450; a pair of fastening devices 500, 550; and one or more switch devices 600 may be incorporated into a single assembly when applied to a particular type of circuit breaker. Accordingly, the device 400 may be appropriately configured for application to many different types of circuit breakers within the spirit and scope of the present invention. Thus, when the device 400 is secured to the circuit breaker apparatus 200 via the fastening devices 500, 550, actuation of one of the actuators 425, 450 thereby causes that actuator to physically engage the corresponding circuit breaker operating device 300, 350 so as to trip or reset the circuit breaker apparatus 200, as appropriate.

In order to provide for remote operation of the circuit breaker apparatus 200, the device 400 may further include a controller 700 in communication with and capable of controlling the device 400. Such communication between the controller 700 and the device 400 may be accomplished via a wired connection 725 shown in FIG. 3A or via a wireless connection 750 as shown in FIG. 3B. In one embodiment, the controller 700 may have appropriate switches 800, 850 corresponding to each of the actuators 425, 450 for operating the respective one of the open and close circuit breaker operating devices 300, 350. Such a configuration of the controller 700 thus allows the operator to operate the circuit breaker apparatus 200 from a remote location with respect thereto so as to reduce the risk associated therewith. In addition, embodiments of the present invention provide a device 400 that may be applied externally to an enclosed circuit breaker apparatus 200 in an effective and cost-efficient manner, without requiring special accommodations for special types of enclose circuit breakers, while still providing the desired remote operation thereof. An added advantage is that such a device 400 and associated controller 700 may be applied to many different types of circuit breakers without requiring special or extensive modifications.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A device adapted for remote operation of a circuit breaker apparatus, the circuit breaker apparatus having a trip device and a reset device operably engaged therewith, the trip device and the reset device being configured to be externally accessible with respect to an enclosure enclosing the circuit breaker apparatus, and the trip device being separate with respect to the reset device, said device comprising:

a pair of linear actuators capable of being operably engaged with the circuit breaker apparatus, externally to the enclosure, and one of the linear actuators being configured to be capable of physically engaging the trip device and the other of the linear actuators being configured to be capable of physically engaging the reset device, each of the trip device and reset device being operatively responsive to a substantially perpendicular axial force directed thereto by the respective linear actuator; and a controller device in communication with the linear actuators and capable of being remotely disposed with respect thereto, the controller device being capable of selectively actuating the linear actuators to impart the substantially perpendicular axial force toward the respective trip device and reset device from a remote location with respect to the circuit breaker apparatus, so as to at least one of actuate the trip device to trip the circuit breaker apparatus and actuate the reset device to reset the circuit breaker apparatus.

2. A device according to claim 1, wherein at least one actuator is removably engaged with the circuit breaker apparatus.

3. A device according to claim 1, wherein the enclosure is comprised of a metallic material and at least one actuator in configured to be removably engaged with the circuit breaker apparatus with a magnetic fastening device operably engaged with the at least one actuator.

4. A device according to claim 3 further comprising a switch device operably engaged with the magnetic fastening device and configured so as to be capable of actuating and deactuating the magnetic fastening device.

5. A device according to claim 1, wherein at least one actuator further comprises an actuatable solenoid.

6. A circuit breaker assembly, comprising:

a circuit breaker apparatus having a trip device and a reset device operably engaged therewith, the trip device and the reset device being configured to be externally accessible with respect to an enclosure enclosing the circuit breaker apparatus, and the trip device being separate with respect to the reset device, each of the trip device and the reset device being operatively responsive to a substantially perpendicular axial force directed thereto; and a device operably engaged with the circuit breaker apparatus and configured so as to provide remote operation thereof, said device comprising:

a pair of linear actuators capable of being operably engaged with the circuit breaker apparatus, externally to the enclosure, and one of the linear actuators being configured to be capable of physically engaging the trip device and the other of the linear actuators being configured to be capable of physically engaging the reset device; and a controller device in communication with the linear actuators and capable of being remotely disposed with respect thereto, the controller device being capable of selectively actuating the linear actuators to impart the substantially perpendicular axial force toward the respective trip device and reset device from a remote location with respect to the circuit breaker apparatus so as to at least one of actuate the trip device to trip the circuit breaker apparatus and actuate the reset device to reset the circuit breaker apparatus.

7. A device according to claim 6, wherein at least one actuator is removably engaged with the circuit breaker apparatus.

8. A device according to claim 6, wherein the enclosure is comprised of a metallic material and at least one actuator in configured to be removably engaged with the circuit breaker apparatus with a magnetic fastening device operably engaged with the at least one actuator.

9. A device according to claim 8 further comprising a switch device operably engaged with the magnetic fastening device and configured so as to be capable of actuating and deactuating the magnetic fastening device.

10. A device according to claim 6, wherein at least one actuator further comprises an actuatable solenoid.

11. A method of remotely operating a circuit breaker apparatus, said method comprising:

operably engaging a pair of linear actuators with the circuit breaker apparatus, externally to an enclosure enclosing the circuit breaker apparatus, such that one of the linear actuators is capable of physically engaging a trip device operably engaged with the circuit breaker apparatus and the other of the linear actuators being configured to be capable of physically engaging a reset device operably engaged with the circuit breaker apparatus, each of the trip device and reset device being operatively responsive to a substantially perpendicular axial force directed thereto by the respective linear actuator, and externally accessible with respect to the enclosure, the trip device being separate with respect to the reset device; and controlling the linear actuators with a controller device, remotely disposed with respect thereto and in communication therewith, by selectively actuating the linear actuators to impart the substantially perpendicular axial force toward the respective trip device and reset device via the remotely disposed controller so as to at least one of actuate the trip device to trip the circuit breaker apparatus and actuate the reset device to reset the circuit breaker apparatus.

12. A method according to claim 11, further comprising removably engaging at least one actuator with the circuit breaker apparatus.

13. A method according to claim 11, wherein the enclosure is comprised of a metallic material and the method further comprises removably engaging at least one actuator with the circuit breaker apparatus via a magnetic fastening device operably engaged with the at least one actuator.

14. A method according to claim 13 further comprising operating a switch device operably engaged with the magnetic fastening device so as to at least one of actuate and deactuate the magnetic fastening device.

15. A device according to claim 1, wherein at least one actuator further comprises an actuatable pneumatic device.

16. A device according to claim 1, wherein at least one actuator further comprises an actuatable hydraulic device.

17. A device according to claim 6, wherein at least one actuator further comprises an actuatable pneumatic device.

18. A device according to claim 6, wherein at least one actuator further comprises an actuatable hydraulic device.

* * * * *

UNITED STATES PATENT AND TRADEMARK OFFICE

CERTIFICATE OF CORRECTION

PATENT NO. : 7,623,011 B2
APPLICATION NO. : 11/249049
DATED : November 24, 2009
INVENTOR(S) : Ronald L. Rowe et al.

It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 813 days.

Signed and Sealed this

Seventeenth Day of August, 2010

David J. Kappos

David J. Kappos
*Director of the United States Patent and Trademark Office*